US006902268B1

(12) United States Patent
King et al.

(10) Patent No.: US 6,902,268 B1
(45) Date of Patent: Jun. 7, 2005

(54) PRINTING PROCESS

(75) Inventors: Jeffrey Ronald King, Holmes Chapel (GB); Karen Taylor, Poynton (GB); Simon Richard John Leggett, Marsens (CH); Stefan Schüttel, Murten (CH); Roger Leslie Brentnall, Macclesfield (GB)

(73) Assignees: ILFORD Imaging Switzerland GmbH (CH); ILFORD Imaging UK Limited (GB)

( * ) Notice: Subject to any disclaimer, the term of this patent is extended or adjusted under 35 U.S.C. 154(b) by 874 days.

(21) Appl. No.: 09/713,450

(22) Filed: Nov. 15, 2000

(30) Foreign Application Priority Data

Nov. 18, 1999 (GB) ..... 9927167

(51) Int. Cl.[7] ..... B41J 2/01
(52) U.S. Cl. ..... 347/105; 428/32.28; 428/32.35
(58) Field of Search ..... 428/32.28, 32.35; 347/105

(56) References Cited

U.S. PATENT DOCUMENTS

| | | | |
|---|---|---|---|
| 3,889,270 | A | 6/1975 | Hoffmann et al. |
| 3,968,319 | A | 7/1976 | Mani et al. |
| 4,196,253 | A | 4/1980 | Spence |
| 4,308,542 | A | 12/1981 | Maekawa et al. |
| 4,371,582 | A | 2/1983 | Sugiyama et al. |
| 4,442,247 | A | 4/1984 | Ishikura et al. |
| 4,642,247 | A | 2/1987 | Mouri et al. |
| 4,686,118 | A | 8/1987 | Arai et al. |
| 4,741,969 | A | 5/1988 | Hayama et al. |
| 4,785,313 | A | 11/1988 | Higuma et al. |
| 4,832,984 | A | 5/1989 | Hasegawa et al. |
| 4,879,148 | A | 11/1989 | Neaves et al. |
| 4,954,395 | A | 9/1990 | Hasegawa et al. |
| 4,980,229 | A | 12/1990 | Park et al. |
| 5,027,131 | A | 6/1991 | Hasegawa et al. |
| 5,102,731 | A | 4/1992 | Takimoto et al. |
| 5,194,317 | A | 3/1993 | Sato et al. |
| 5,242,739 | A | 9/1993 | Kronzer et al. |
| 5,254,403 | A | 10/1993 | Malhotra |
| 5,270,103 | A | 12/1993 | Oliver et al. |
| 5,342,688 | A | 8/1994 | Kitchin et al. |
| 5,366,837 | A | 11/1994 | Sakai |
| 5,374,475 | A | 12/1994 | Walchli |
| 5,405,678 | A | 4/1995 | Bilodeau |
| 5,501,902 | A | 3/1996 | Kronzer |
| 5,576,088 | A | 11/1996 | Ogawa et al. |
| 5,589,269 | A | 12/1996 | Ali et al. |
| 5,601,928 | A | 2/1997 | Katayama et al. |
| 5,660,928 | A | 8/1997 | Stokes et al. |
| 5,672,392 | A | 9/1997 | De Clercq et al. |
| 5,712,027 | A | 1/1998 | Ali et al. |
| 5,714,235 | A | 2/1998 | Takeuchi et al. |
| 5,750,200 | A | 5/1998 | Ogawa et al. |
| 5,764,262 | A | 6/1998 | Wu et al. |
| 5,798,179 | A | 8/1998 | Kronzer |
| 5,837,375 | A | 11/1998 | Brault et al. |
| 5,853,540 | A | 12/1998 | Niemoller et al. |
| 5,925,712 | A | 7/1999 | Kronzer |
| 5,962,149 | A | 10/1999 | Kronzer |
| 5,989,701 | A | 11/1999 | Goetzen et al. |
| 6,013,354 | A | 1/2000 | Tomizawa et al. |
| 6,015,624 | A | 1/2000 | Williams |
| 6,017,611 | A | 1/2000 | Cheng et al. |
| 6,033,739 | A | 3/2000 | Kronzer |
| 6,051,305 | A | 4/2000 | Hsu |
| 6,357,871 | B1 * | 3/2002 | Ashida et al. ..... 347/106 |
| 2002/0089568 | A1 * | 7/2002 | King et al. ..... 347/54 |
| 2002/0097312 | A1 * | 7/2002 | King et al. ..... 347/106 |

FOREIGN PATENT DOCUMENTS

| | | | |
|---|---|---|---|
| CA | 2214210 | | 2/1998 |
| EP | 0049040 | | 4/1982 |
| EP | 0237258 | B1 | 2/1994 |
| EP | 0858905 | A1 | 8/1998 |
| EP | 0858906 | A1 | 8/1998 |
| EP | 0 925 945 | A3 | 3/2000 |
| EP | 0983866 | A2 | 3/2000 |
| EP | 0912348 | B1 | 5/2000 |
| EP | 1016544 | A2 | 7/2000 |
| GB | 2337482 | A | 11/1999 |
| JP | 58136482 | A | 8/1983 |
| JP | 59204591 | A | 11/1984 |
| JP | 59204592 | A | 11/1984 |
| JP | 59222381 | A | 12/1984 |
| JP | 60-225796 | | 11/1985 |
| JP | 62-170383 | | 7/1987 |
| JP | 62183380 | A | 8/1987 |
| JP | 62264986 | A | 11/1987 |
| JP | 62264988 | A | 11/1987 |
| JP | 62280067 | A | 12/1987 |
| JP | 62280068 | A | 12/1987 |

(Continued)

*Primary Examiner*—B. Shewareged
(74) *Attorney, Agent, or Firm*—Onofrio Law; Dara L. Onofrio, Esq.

(57) ABSTRACT

There is described a recording medium and related ink jet printing method which comprises the steps of:

1) printing onto a receiving medium which comprises a substrate coated with at least one ink receiving layer comprising polymeric particles having film forming temperatures between 60° to 140 ° C. and a binder, and 2) heating the printed image to form a stable image-protecting coating.

Preferably the printed image is heated by passing through a laminator. Alternatively the printed image is heated by passing through a laminator in conjunction with a second, inert releasing sheet which is held against the top surface of the print material. The second sheet may be used to produce a particular appearance to the final image such as high gloss or a security pattern. The receiving layers of the invention provide bright images after printing and fusing which show a high level of scratch and rub resistance even when wet.

12 Claims, No Drawings

FOREIGN PATENT DOCUMENTS

| | | | | | |
|---|---|---|---|---|---|
| JP | 01085767 | A | | 3/1989 | |
| JP | 01085768 | A | | 3/1989 | |
| JP | 04021446 | A | | 1/1992 | |
| JP | 07237348 | A | | 9/1995 | |
| JP | 09104164 | A | | 10/1995 | |
| JP | 08002090 | A | | 1/1996 | |
| JP | 08207426 | A | | 8/1996 | |
| JP | 08282090 | A | | 10/1996 | |
| JP | 09104163 | A | | 4/1997 | |
| JP | 11-301108 | | * | 11/1999 | ..... B41M/5/00 |
| WO | WO 98/02314 | | | 1/1998 | |
| WO | WO00/72984 | A1 | | 12/2000 | |

* cited by examiner

PRINTING PROCESS

FIELD OF INVENTION

This invention relates to a recording medium and to a method for the treatment of images produced therewith.

BACKGROUND OF THE INVENTION

This invention relates to a recording medium particularly suitable to use with ink jet printers and to a method for the treatment of images prepared therewith. It particularly relates to images produced using so-called aqueous inks, that is to say inks in which water comprises the major component of the liquid phase. There is increasing interest in the use of aqueous inks for environmental and safety reasons.

Printing media suitable for use with ink jet printers are well known. Commonly these employ at least one ink receiving layer coated on a suitable substrate. The purpose of the receiving layer is to take up the ink rapidly and improve image quality. One problem with images produced using aqueous inks is that they can be insufficiently robust to handling, and that the image or the receiving layer on which it is printed is sensitive to rubbing and scratching. In addition the printed image frequently becomes more sensitive to handling and damage under damp conditions, and can sometimes be washed completely away.

Several methods of overcoming the poor robustness of images produced using aqueous inks are known. For instance various additional coatings and treatments for ink receiving layers have been proposed, such as lacquers or varnishes which have to be applied after printing the image, thus requiring additional equipment. For instance our British Patent Application 2337482 A provides a method for increasing the rub resistance of an image by coating or over-printing the image with an aqueous solution of a styrene acrylate polymer.

Another method of improving the robustness of printed images is to laminate or encapsulate them, and this is particularly common when they are intended for external display. By lamination is meant the combination of a printed image with a transparent overlay, this combination usually being accomplished with an adhesive activated by heat, pressure, or both. The overlay acts as a physical protection for the image and completely seals it from ingress of water. By encapsulation is meant the combination of a printed image layer between two laminating sheets, that on the image surface being transparent, the combination being accomplished with an adhesive activated by heat, pressure, or both. Encapsulation is most effective if the laminating sheets extend beyond the printed image and are bonded to each other at the extremities, thus preventing ingress of water through exposed edges of the image.

However lamination and encapsulation are both expensive because additional materials are required together with additional handling and equipment, and there is considerable interest in finding a cheaper and simpler method of increasing the robustness of images produced using aqueous inks.

As an alternative to lamination or overprinting, Japanese Patent Applications 59/222381, 07/237348, 08/02090, and 09/1104164 and European Patent Applications 0 858 905 and 0 858 906 disclose a heat seal method of protecting an ink jet image wherein the receiving system comprises two layers coated on a suitable base. The lower layer is an ink receiving layer which is absorbent to the ink, whereas the upper layer comprises a film forming polymer in a binder. After printing the upper layer may be sealed by heating to form a robust barrier to protect the image in the lower layer. This is similar to laminating the image, but does not require the additional expensive lamination sheet.

However this heat seal method needs to achieve high temperatures to seal the image (up to 170° C. being given in the Examples of EP 0 858 906 A) and also requires a relatively complicated and expensive receiving sheet. There is thus still a need for an imaging material and method which will provide images resistant to washing and handling when printed using aqueous inks without lamination. We have found a material and method which achieves these objectives.

SUMMARY OF THE INVENTION

According to the present invention there is provided a printing method which comprises the steps of:

1) Printing on to a receiving material which comprises on a suitable substrate at least one ink receiving layer which comprises a particulate polymer which is characterised by a film forming temperature of between 60° to 140° C. together with at least one binder, and 2) Subsequently heating and applying pressure to the printed image to fuse the polymer.

The method and materials of the invention are much simpler than is previously known heat sealing methods for printed images because the receiving layer may consist of only a single layer rather than the minimum of two known previously, and is thus considerably simpler and cheaper to manufacture. The receiving layers of the invention provide bright images after printing and fusing which show a high level of scratch and rub resistance even when wet.

DETAILED DESCRIPTION OF THE INVENTION

Suitable substrates to carry the layers of the invention include any of those commonly used for printing and imaging media, for example paper, high wet-strength paper, tracing paper, heavyweight paper, card, board, treated paper such as resin or polyethylene coated paper, transparency materials, synthetic papers, canvas, cloth, fabric, metals such as aluminium, and polymeric substrates such as cellulose acetates, poly(ethylene), poly(propylene), poly (vinyl chloride), and polyesters including poly (ethylene terephthalate) and poly (ethylene naphthalate).

Preferably the binder is a hydrophilic binder. Suitable hydrophilic binders include poly (vinyl alcohol), copolymers of poly (vinyl alcohol), carbohydrates such as tragacanth gum or starch, modified carbohydrates such as hydroxyethyl cellulose or carboxymethyl cellulose, polyacrylates, poly (vinyl pyrrolidone), poly(ethylene imine), gelatin, casein and mixtures of such binders. A particularly suitable hydrophilic binder is poly (vinyl alcohol). It is to be understood that commercial samples of poly (vinyl alcohol) are normally prepared by hydrolysis of poly (vinyl acetate), and that this hydrolysis does not always go to completion. Thus a preferred hydrophilic binder is poly (vinyl alcohol) which has a degree of hydrolysis of at least 90%, and a particularly preferred binder is poly (vinyl alcohol) which has a degree of hydrolysis of about 99%. This is hereinafter referred to as 99% PVA.

Suitable polymers for the particulate polymer include low density polyethylene and copolymers of ethylene with other ethylenically unsaturated monomers, such as acrylate monomers. A suitable particle size for the particulate polymer is between about 1 μm and about 50 μm, with a particle size between about 5 μm and about 20 μm being preferable. A particularly suitable particulate polymer comprises low density polyethylene spherical beads having an average diameter of about 12 μm. Another particularly suitable particulate polymer comprises spherical beads of a 7% acrylic acid/polyethylene copolymer having an average diameter of about 10 μm. Another suitable particulate polymer comprises polyethylene beads of random shape and a particle size of about 25 μm. These polymers have crystalline melting points of 105–107° C.

A suitable coating weight for the receiving layer is from about 5 to about 50 $gm^{-2}$. A preferred coating weight for the receiving layer is from about 20 to about 40 $gm^{-2}$. The ratio of the coating weight of the particulate polymer to that of the hydrophilic binder may be from about 20:1 to about 1:1, but preferably is between about 10:1 and about 5:1.

The receiving layer may advantageously also comprise additives which are commonly added to ink receiving layers such as surfactants to improve coating quality, cross linking agents, optical brightening agents, inorganic pigments or fillers such as chalk, silica, alumina, kaolin and the like, light stabilisers, biocides, and dye fixatives such as the polymers provided by U.S. Pat. Nos. 5,342,688, 5,589,269, and 5,712,027. Suitable cross linking agents for the preferred poly (vinyl alcohol) binders of the invention include aldehydes such as glyoxal, boric acid, poly ethylene imines, and divalent metallic cations.

According to a preferred aspect of this invention, the printed image is heated by passing through a laminator. By laminator is meant a device which is normally used for the lamination of printed images which comprises a means of heating and pressing together the image and the laminating sheet thus causing the two to adhere, commonly by passing them through a nip between a pair of heated rollers. This aspect is particularly preferable because many printing and processing houses already possess and use laminators which can be applied to the materials of this invention. However the advantage of this invention is that the additional expensive lamination sheet is unnecessary.

According to another aspect of the invention, the printed image is heated by passing through a laminator in conjunction with a second, inert sheet which is held against the image protective layer of the material. The inert sheet does not adhere to the material, but protects it from the rollers of the laminator. Moreover the use of a smooth inert sheet will impart a high gloss or other desired appearance to the final image. Alternatively a suitable choice of the inert sheet may be used to produce a pattern such as a security symbol after contacting with the image. The inert sheet may then be recycled almost indefinitely.

The method and materials of the invention are particularly suited to the treatment of images produced using ink jet printers. Aqueous inks are commonly used in such printers, particularly those designed for use in the home or office, but the invention is also suitable for ink jet printers using non-aqueous inks such as those based on mineral oils and organic solvents. Ink jet printing is a non impact printing method that in response to a digital signal produces droplets of ink that are deposited on a substrate to produce an image. Ink jet printing has found broad application in recent years. Any convenient ink jet printer may be used, for example a continuous printer or a piezoelectric or thermal drop-on-demand printer.

The invention may also be used with other printing methods such as flexographic printing, with pen type plotters, or with marker pens and the like. Suitable colorants for the inks include dyes or pigments. Preferred inks for the invention are pigmented aqueous inks.

The materials and method of this invention are suitable for many uses where robustness of an ink jet image is important, such as posters, banners, displays, labels, and the like. The method of this invention is also particularly suitable for use with a wide variety of packaging materials, e.g a heavy weight paper, card, or board.

The materials and method of this invention are also particularly suitable as a security printing system, and this aspect of the invention is especially preferred. After the material has been sealed by heating it is no longer receptive to inks, and is thus difficult to alter and offers high levels of protection from fraud and forgery. In an additional aspect of the invention when it is used as a security printing system, a suitable mark or pattern such as, for example, a holographic pattern may be embossed on or transferred to the image at the heating stage. This pattern may be carried on the inert sheet used in contact with the image during the heating stage, or may be carried on a roller or stamp used in contact with the image at the heating stage.

Various ink receiving materials which comprise a combination of a particulate polymer and a hydrophobic binder are already known. For instance U.S. Pat. No. 3,968,319 discloses a particulate polymer for use in paper coatings, U.S. Pat. No. 4,196,253 discloses a paper coated with a binder and organic particles, U.S Pat. No. 4,371,582 discloses an ink jet recording sheet containing a basic latex polymer, U.S. Pat. No. 4,442,247 discloses a coating composition comprising a combination of an aqueous resin with an insoluble resin, U.S. Pat. No. 4,686,118 discloses a recording medium wherein the coating comprises a combination of a hydrophilic and a hydrophobic polymer, U.S. Pat. No. 5,102,731 discloses a recording medium wherein the coated layer comprises a hydrophilic urethane resin and fine organic or inorganic particles, U.S. Pat. No. 5,254,403 discloses a coated recording sheet wherein the receiving layer comprises a mixture of a latex polymer with two hydrophilic polymeric binders, U.S. Pat. No. 5,270,103 discloses a receiver sheet coated with a coating comprising a pigment, a binder, and a latex polymer, U.S. Pat. No. 5,405,678 discloses a coating comprising a latex polymer which has not been completely coalesced, U.S. Pat. No. 5,672,392 discloses a process for preparing ink jet recording materials whereof the coatings comprise starch, an insoluble copolymer, and a binder, U.S. Pat. No. 5,714,235 discloses an ink jet recording sheet containing casein and a styrene-butadiene rubber, U.S. Pat. No. 5,925,712 discloses a fusible printable coating wherein one of the alternative compositions comprises a combination of a powdered thermoplastic polymer and a binder, and Japanese Patent Applications 59/204591 and 59/204592 disclose ink jet receiving coatings which comprise microcapsules which are ruptured after printing to improve the robustness of the image. However the method of this invention is novel and the coatings are particularly suitable for the method The following Examples will serve to illustrate the invention:

EXAMPLE 1

A formulation was prepared using the following components:

| | |
|---|---|
| Poly (vinyl alcohol) 10% solution | 40.0 g |
| Silicone surfactant | 0.2 g |
| Ethylene acrylic acid copolymer beads | 25.0 g |
| Optical Brightening Agent | 0.2 g |
| Deionised water | 34.6 g |

This formulation was coated on to a subbed poly (vinyl chloride) substrate to give a coating weight of 25 $gm^{-2}$. An image was printed with pigmented inks using a Novajet III printer, and the coating was passed through a GBC 1200 laminator at a heat setting corresponding to a temperature of 120° C. together with a piece of paper to seal the image. The paper was removed leaving a smooth clear glossy image which was resistant to wet rubbing.

EXAMPLE 2

A formulation was prepared using the following components:

| | |
|---|---|
| Poly (vinyl alcohol) 10% solution | 400 g |
| Silicone surfactant | 2 g |
| Polyethylene beads | 250 g |
| Deionised water | 348 g |

The poly (vinyl alcohol) used was a commercial sample from Harco under the trade name Mowiol 28-99 having a degree of hydrolysis of 99%. The surfactant was from BYK Chemie under the trade name BYK 348. The polyethylene beads were low density polyethylene spherical beads having an average diameter of about 12 $\mu$m available under the trade name Flothene from Sumitomo. The formulation was coated on to a substrate comprising plain paper having a substance of 80 $gm^{-2}$ to give a wet coating weight of 100 $gm^{-2}$, approximately 29·2 $gm^{-2}$ when dry. An image was printed with pigmented inks using a Novajet III printer, and the coating was passed through a GBC 1200 laminator at a heat setting corresponding to a temperature of 115° C. with the image surface in contact with a piece of clear film to seal the image. The film was removed leaving a smooth clear glossy image which was resistant to wet rubbing.

EXAMPLE 3

A formulation was prepared using the following components:

| | |
|---|---|
| Poly (vinyl alcohol) 10% solution | 400 g |
| Silicone surfactant | 2 g |
| Polyethylene particles | 250 g |
| Deionised water | 348 g |

The poly (vinyl alcohol) used was a commercial sample from Harco under the trade name Mowiol 56-98 having a degree of hydrolysis of 98%. The surfactant was from BYK Chemie under the trade name BYK 348. The polyethylene particles were low density polyethylene particles of random shape and average particle size about 25 $\mu$m available under the trade name Coathylene HX1681 from duPont. The formulation was coated on to a substrate comprising plain paper having a substance of 80 $gm^{-2}$ to give a wet coating weight of 100 $gm^{-2}$, approximately 29·2 $gm^{-2}$ when dry. An image was printed with pigmented inks using a Novajet III printer, and the coating was passed through a GBC 1200 laminator at a heat setting corresponding to a temperature of 115° C. with the image surface in contact with a piece of clear film to seal the image. The film was removed leaving a smooth clear glossy image which was resistant to wet rubbing.

Finally, it is understood that variations and modifications from the examples given herein are possible in view of the foregoing disclosure. Therefore, although the invention has been described with reference to certain preferred embodiments it will be appreciated that other ink receiving layer materials may be used, which are nevertheless within the scope and spirit of the invention as defined in the claims appended hereto.

What is claimed is:

1. An ink jet printing method comprising the steps of:

a. printing on to a receiving medium which comprises a substrate coated with a single ink receiving layer comprising polymeric particles having film forming temperatures between 60 to 140° C. and a binder; and b. heating the printed image to form a stable image-protecting coating.

2. A method according to claim 1, wherein said ink receiving layer is coated as an aqueous formulation on top of said substrate.

3. A method according to claim 1, wherein the printed image is heated under pressure to form the protective coating.

4. A method according to claim 1, wherein the printed image is heated by passing through a laminator.

5. A method according to claim 4, wherein an inert sheet is in contact with said ink receiving layer and passed through said laminator.

6. A method according to claim 5, wherein said inert sheet is selected from the group consisting of release papers, release liners, silicone release liners, casting films, casting papers and polyester films.

7. A method according to claim 5, wherein said inert sheet is used to impart a high gloss, embossed pattern or security symbol to the final image.

8. A method according to claim 1, wherein said binder is a hydrophilic binder.

9. A method according to claim 8, wherein said hydrophilic binder is polyvinyl alcohol.

10. A method according to claim 1, wherein said particulate polymer comprises low density polyethylene.

11. A method according to claim 10, wherein said particulate polymer comprises low density polyethylene particles having an average particle size of approximately 25 $\mu$m.

12. A method according to claim 1, wherein the inks used to print the image on said receiving layer are selected from the groups consisting of aqueous inks, mineral oil inks and inks based on organic solvents.

* * * * *

UNITED STATES PATENT AND TRADEMARK OFFICE

CERTIFICATE OF CORRECTION

PATENT NO. : 6,902,268 B1
DATED : June 7, 2005
INVENTOR(S) : King et al.

It is certified that error appears in the above-identified patent and that said Letters Patent is hereby corrected as shown below:

Column 1,
Line 63, delete “09/1104164” and insert -- 09/104164 --.

Column 2,
Line 28, delete “is”.

Signed and Sealed this

Sixth Day of September, 2005

JON W. DUDAS
*Director of the United States Patent and Trademark Office*